United States Patent [19]

Hung

[11] 4,238,163

[45] Dec. 9, 1980

[54] MAGNETIC WRITING IMPLEMENT

[76] Inventor: Kuo-Hua Hung, 52, Sec. 1, Hsin Sheng N.Rd., Taipei, Taiwan

[21] Appl. No.: 942,153

[22] Filed: Sep. 14, 1978

[51] Int. Cl.[3] ..... B43K 21/02

[52] U.S. Cl. ..... 401/89; 401/100; 401/85

[58] Field of Search ..... 401/89, 100, 82, 57, 401/83, 84, 90, 85, 211, 86

[56] References Cited

U.S. PATENT DOCUMENTS

| | | | |
|---|---|---|---|
| 650,078 | 5/1900 | Keck | 401/57 X |
| 846,442 | 3/1907 | Ashley | 401/89 |
| 2,678,578 | 5/1954 | Bonanno | 401/100 |
| 2,870,741 | 1/1959 | Kersten | 401/100 |
| 3,338,215 | 8/1967 | Clin et al. | 401/82 |
| 3,708,235 | 1/1973 | Kolomeir | 401/90 X |
| 3,790,291 | 2/1974 | Hung et al. | 401/57 |

OTHER PUBLICATIONS

Moore, H. N., Ball Point Fountain Pen, abstract No. 615908, published 2/50.

*Primary Examiner*—William Pieprz
*Attorney, Agent, or Firm*—J. Harold Nissen

[57] ABSTRACT

A magnetic writing implement comprises a tubular casing with a writing unit which is frictionally interfitted with the conical end of the casing, a storage tube slideably engaged within the casing for storing a plurality of writing units therein, an ejector and a push tube connected with the front end and rear end of the storage tube, respectively for ejecting the writing unit from the conical end of the casing as its writing point becomes blunt for replacement by a sharpened unit, and a stopper inserted in the rearmost portion of the push tube to prevent the stored writing units from slipping out of the tube. Each writing unit carries a sharpened lead pencil element or the like at its front portion and includes a piece of magnet at its rear end. The ejector and the stopper also contain a piece of magnet at each of their front ends. Each of the pieces of magnet in the present writing implement are secured with the same magnetic pole oriented in the same direction, so that each rear end of the writing unit has a magnetic pole different from those at the front ends of the ejector and the stopper. Therefore, the rear end of each writing unit may be attracted at the front end of the ejector or stopper by magnetic force.

5 Claims, 7 Drawing Figures

MAGNETIC WRITING IMPLEMENT

BACKGROUND OF THE INVENTION

In a conventional writing instrument with a pre-sharpened lead pencil element, such as that shown in U.S. Pat. No. 3,338,215, a number of pre-sharpened lead cartridges or writing units are contained in a tubular holder or casing to form the pencil body. At its rear end, the casing is provided with clicking means to prevent the foremost writing unit from retracting into the casing during use.

These cartridges are then connected in the casing with the front end of one unit received in a recess at the rear end of the next adjacent cartridge.

This arrangement has the disadvantage that when the pencil is in use, the foremost writing unit is supported only at the end where the unit projects out of the casing. Consequently, the foremost writing unit is unstable and wobbly, which causes discomfort in writing.

Another disadvantage with this type of pencil is the difficulty encountered in inserting the last writing unit into the locking means at the rear end of the casing whenever the replacement of a fresh cartridge is required.

Furthermore, because it is difficult to control the inner diameter of the locking means at both ends of the pencil during manufacturing, especially when plastic material is used to form a casing, the inner diameter of both locking means is always either larger or smaller than the outer diameter of the cartridge to be fitted. A larger diameter of the locking means will generally result in the writing unit slipping out from the casing.

Still another disadvantage of this type of pencil is that, if one of the writing units or cartridges is accidentally lost, the remaining writing units contained in the tubular casing will not be able to retain the cartridge assembly, and the entire pencil becomes unusable.

In another conventional writing instrument with a pre-sharpened lead pencil element, shown in Austrian Pat. No. 68637, a number of pre-sharpened leads are contained in an inner front barrel and a push stem is supported by a fixed inner rear barrel, inside which a movable barrel is provided for pushing the push stem so as to project one writing unit each time out of the casing. In addition, a guide ring securely fitted in the casing for the guidance of the movable barrel, spring, supporting union and the pressing and are still particularly needed to perform its functions. One of the disadvantages of this type of pencil is that many parts are required to form a pencil body. This complicated construction will always be accompanied by manufacturing difficulties thus increasing the cost of the pencil. Another disadvantage of this type of pencil is that each writing unit is cylindrically fitted with the casing, between which a critical tolerance is necessary, otherwise, the writing unit will fail in use.

The present invention thus generally relates to a novel magnetic writing implement and, more particularly, to a pencil adapted to avoid the disadvantages of the pencils of the prior art.

BRIEF DESCRIPTION OF THE INVENTION

The present invention device provides each individual cartridge or writing unit with a piece of magnet secured at its rear end and an ejector having a piece of magnet secured at its front end. In this matter, the writing unit is attracted at the front end of the ejector by magnetic force when said end is located at the conical end of the implement and approaches the rear end of the writing unit. The present implement is held vertically and the casing pressed downwardly to insert the writing unit into the conical end of the present implement.

The present invention also provides a stopper having its reduced front portion frictionally engaged with the inner surface of the rear end of the push tube for preventing the stored writing units in the store tube from slipping out of the push tube. Furthermore, there is also a piece of magnet secured at the front end of the stopper, which may attract the writing unit with magnetic force and transfer the attracted writing unit out from behind the push tube to the front end of the ejector located in the conical end. The casing is then pressed downwardly and vertically to insert the writing unit into the conical end.

These and other objects and features of this invention will be better understood and appreciated from the following detailed description of a preferred embodiment thereof, by way of example only, in the accompanying drawings.

DETAILED DESCRIPTION OF THE INVENTION

Figure 1:
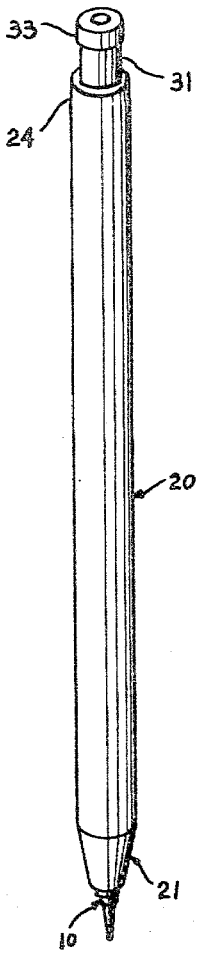
FIG. 1 is a perspective view of the magnetic writing implement according to the present invention.
Figure 2:
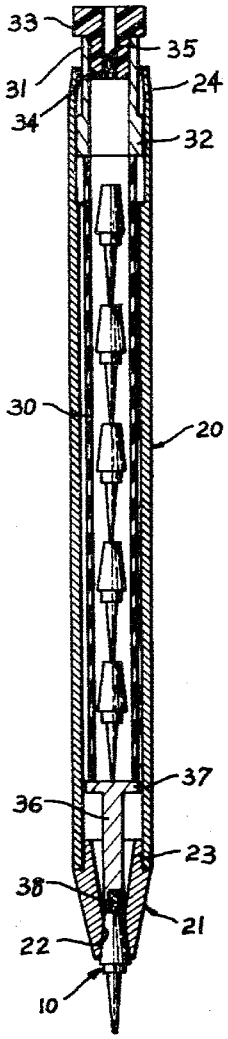
FIG. 2 is an enlarged vertical longitudinal sectional view through the writing implement in FIG. 1.

As shown in FIGS. 1 and 2, the magnetic writing implement of the present invention mainly comprises a writing unit 10, a casing 20 and storage and ejecting means.

Figure 3:
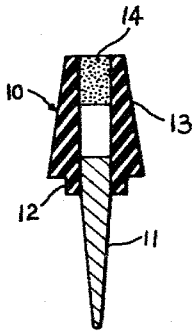
FIG. 3 is an enlarged longitudinal sectional view of a writing unit according to the present invention.
Figure 4:
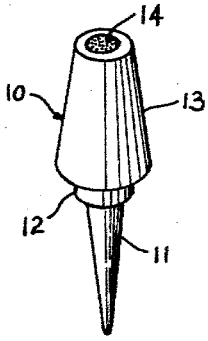
FIG. 4 is a perspective view of the writing unit of FIG. 3.

The writing unit 10 as shown in FIGS. 3 and 4, includes a front portion 12 and a rear portion 13. The front portion 12 is provided for holding the writing point 11. The rear portion 13 has an expanded section which is sharply enlarged and then gradually reduced and tapered down to the rear end, thus a step is formed between the front portion 12 and the rear portion 13. According to the present invention, an important feature of the writing unit 10 is that a piece of magnet 14 is secured in the center of its rear end. The function of the rear portion 13 and the magnet 14 will be described in conjunction with the conical end of the casing 20 hereafter.

The casing 20 comprises a tubular casing with an internal hollow having an enlarged inner diameter on it rear portion and a slightly rearwardly conical rear end 24. The conical end 21 has a reduced connecting portion 23 for inserting into the hollow of the casing 20 and has an internal hollow of corresponding rearwardly conical taper 22 to adapt for receiving the expanded rear portion 13 of the writing unit 10 in a secure press-fitted or frictionally engaged relation. In this manner, the writing unit 10 is securely interfitted by its expanded rear portion 13 with a conically tapered front end 22 thereby to form a secure engagement with each other.

The storage and ejecting means mainly comprises a storage tube 30, an ejector 36, a push tube 31 and a stopper 33. The storage tube 30 is slideably engaged within the tubular casing 20 and is provided for storing the remaining writing units in its internal hollow. The ejector 36 includes a straight rod having a length equal to the same of the conical end 21 connected on the casing 10, and a enlarged rear end 37 for supporting and closing the front end of the storage tube 30. The push tube 31 connecting with the rear end of the storage tube 30 has an inner diameter equal to the inner diameter of storage tube 30 and has a enlarged outer diameter on its front portion 32, which corresponds to the inner diameter of the rear portion of the casing 20, so that the push tube 31 may be moved frictionally forth or back along the enlarged internal hollow on the rear portion and is restricted by the reduced rear end 24 of the casing 20. The top end of the push tube 31 is closed by a stopper 33 which has a front section 34 frictionally engaged with the inner surface of the push tube 31 for preventing the stored writing units in the store tube 30 from slipping out of the tube when the casing 10 or the store tube 30 is upside-down.

An important feature of the store and pushing means is that each front end of the ejector 36 and the stopper 33 contains a piece of magnet 38(35) for attracting the writing unit 10 with magnetic force. To accomplish this object, the magnets 14, 38, 35 on the writing units 10, the ejector 36 and the stopper 33 are secured therein with the same magnetic pole oriented in the same direction. That is to say that the magnetic pole at the rear end of each writing unit 10 is contary to those at the front ends of the stopper 33 and the ejector 36, so that the writing unit 10 may be attracted on the front ends of the stopper 33 and the ejector 36 as shown in the FIGS. 5 and 6.

Figure 7:
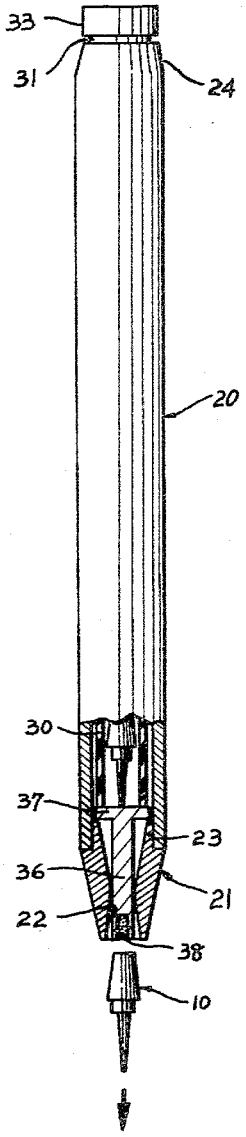
FIG. 7 is a partial sectional view of FIG. 2 illustrating a writing unit being ejected out of the conical end of the present implement when the top of stopper is pressed by a thumb.

The main advantage of the present invention is that when a change of the writing unit 10 is required, fingers of our hand are unnecessary to grasp the writing unit 10. As shown in FIG. 7, when the top of the stopper 33 is pressed down by a thumb, the ejector 36 is also pressed down by the store tube 30 to eject the writing unit 10 out of the conical end 21 of the implement. Meanwhile, the enlarged rear end 37 of the ejector 36 is restricted to move further by the connecting portion 23 of the conical end 21 of the implement, and its front end containing the magnet 38 is just located at the front end of the internal hollow of the conical end 21.

Figure 5:
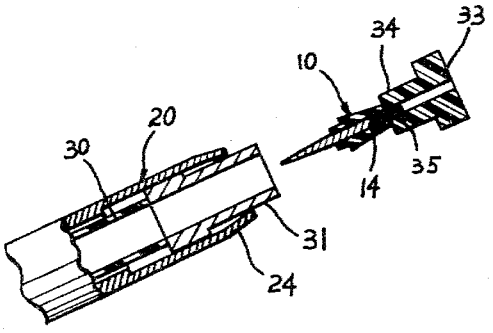
FIG. 5 is a sectional view of the rear portion of the present invention illustrating a writing unit attracted at the front end of stopper by magnetic force and being withdrawn out of the push tube.
Figure 6:
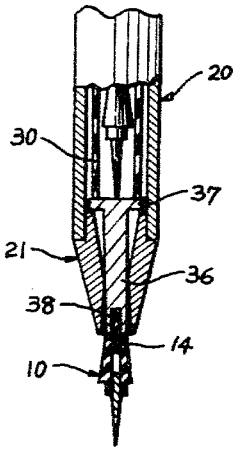
FIG. 6 is a sectional view of the front portion of the present invention illustrating a writing unit attracted at the front end of ejector located at the conical end.

A plurality of writing units 10 may be stored in a box on desk or in the storage tube 30 of the present implement. The rearmost writing unit 10 may be attracted on the stopper 33 by turning the casing 20 and the store tube 30 upside-down, then withdraw the stopper 33 with the attracted writing unit 10 out of the push tube 31 and transfer the writing unit 10 to the front end of the ejector 36 located at the front end of the conical end 21 as shown in FIGS. 5 and 6. Another method is that simply approach the front end of the conical end 21 to a plurality of writing units 10 in a box on desk to attract one of them as shown in FIG. 6. Subsequently, press the casing 20 downwardly and vertically to insert the writing unit 10 into the internal hollow of the conical end 21. Thus the writing unit 10 is secured and fastened therein.

From the foregoing description it will be appreciated that several advantages are derived from this invention, such as it is unnecessary for the writing unit to be grasped by fingers when a change of the writing unit is required, and therefore, no graphite or coloured trace will be printed on fingers. Another advantage is that the present invention can also be considered as a magnetic toy for children, aside its main function of writing.

It should also be appreciated that the term "writing implement" described herein is not limited only to pencil, but encompasses all kinds of writing bodies, such as ball pens, crayons or markers and the like.

Having described this invention in detail, those skilled in the art will appreciate that numerous modifications may be made thereof without departing from the spirit of this invention. Therefore, it is not intended that the breadth of this invention be limited to the specific embodiment illustrated and described. Rather, it is intended that the scope of this invention be determined by the appended claims and their equivalents.

What is claimed is:

1. A writing implement, of the type having a casing member including a writing unit socket in the front end thereof, and having an interchangeable writing unit with a front portion for holding the writing point and a rear portion to be received into the writing unit socket, comprising a first magnet mounted on the rear portion of said writing unit;

front magnet means including a second magnet mounted in said casing member near the front end thereof;

said first magnet and said second magnet each having their poles normally aligned in the same direction, to draw said writing unit into said socket and to hold said writing unit in engagement with said casing member by the mutual attraction between said first and said second magnets;

a storage tube mounted in said casing member, operable to store a plurality of said writing implements and having an open rear end and a front end;

rear magnet means including a removable stopper operable to close said storage tube open rear end; and a third magnet secured to said stopper, said third magnet having its poles normally aligned in the same direction the poles of said first and second magnets to attract and hold writing implements stored in said tube, for removal of said writing implements from said tube.

2. The writing implement of claim 1, further comprising a push tube slideably mounted in the rear of said casing member in abutting engagement with said storage tube; and, said storage tube being slideably mounted in said casing member;

said front magnet means comprising an ejector including a straight rod with an enlarged rear end engaging the front end of said storage tube, said second magnet being mounted on the front end of said rod, said ejector being slideably mounted in said casing, said rod being operable to extend through said socket to push said writing implement out of said socket in response to the forward sliding of said storage tube engaged with the rear end of said rod; and, said rear magnet means being slideably mounted in said casing and in abutment with said push tube whereby pushing on said rear magnet means causes the push tube, to slide forward causing in turn the storage tube and the ejector to slide forward.

3. The writing implement of claim 2 wherein said socket comprises a conical shaped end member, and said writing unit includes a rearward portion conically tapered to securely interfit with said end member.

4. The writing implement as set forth in claim 2, and said casing member having a slightly rearwardly conical rear end and an enlarged inner diameter in the rear portion of said casing member for slideably and frictionally engaging said push tube.

5. The writing implement as set forth in claim 2, said push tube having an enlarged portion for slideably and frictionally engaging in said rear portion of said tubular casing.

* * * * *